US009847574B2

(12) United States Patent
Martiskainen et al.

(10) Patent No.: US 9,847,574 B2
(45) Date of Patent: Dec. 19, 2017

(54) MULTIBAND HELICAL ANTENNA

(71) Applicant: GALTRONICS CORPORATION, LTD., Industrial Zone, Upper Tiberias (IL)

(72) Inventors: Matti Martiskainen, Upper Tiberias (IL); Victor Hoepfner, Upper Tiberias (IL)

(73) Assignee: GALTRONICS CORPORATION, LTD., Tempe, AZ (US)

( * ) Notice: Subject to any disclaimer, the term of this patent is extended or adjusted under 35 U.S.C. 154(b) by 136 days.

(21) Appl. No.: 14/930,433

(22) PCT Filed: Apr. 30, 2014

(86) PCT No.: PCT/IL2014/050392

§ 371 (c)(1),
(2) Date: Nov. 2, 2015

(87) PCT Pub. No.: WO2014/178052

PCT Pub. Date: Nov. 6, 2014

(65) Prior Publication Data

US 2016/0126630 A1 May 5, 2016

Related U.S. Application Data

(60) Provisional application No. 61/817,909, filed on May 1, 2013.

(51) Int. Cl.
*H01Q 21/00* (2006.01)
*H01Q 5/307* (2015.01)
(Continued)

(52) U.S. Cl.
CPC ..... *H01Q 5/307* (2015.01); *H01Q 1/362* (2013.01); *H01Q 9/30* (2013.01); *H01Q 11/12* (2013.01); *H01Q 21/30* (2013.01); *H01Q 9/40* (2013.01)

(58) Field of Classification Search
CPC ..... H01Q 5/30; H01Q 1/36; H01Q 21/00
(Continued)

(56) References Cited

U.S. PATENT DOCUMENTS 5,612,704 A * 3/1997 Cole ..... H01Q 1/244 343/702
5,757,325 A * 5/1998 Saldell ..... H01Q 9/30 343/702

(Continued)

FOREIGN PATENT DOCUMENTS

CN 1783580 A 6/2006
CN 101192711 A 6/2008
WO 2013028050 A1 2/2013

OTHER PUBLICATIONS

State Intellectual Property Office of the People's Republic of China, Office Action in Chinese Patent Application No. 201480037259.1 dated Apr. 1, 2017.

*Primary Examiner* — Huedung Mancuso
(74) *Attorney, Agent, or Firm* — Lorenz & Kopf, LLP

(57) ABSTRACT

A multiband antenna including a feed point, a helical radiating element galvanically connected to and fed by the feed point, the helical radiating element resonating in a Very High Frequency range and an elongate radiating element arranged coaxially within the helical radiating element and galvanically connected to and fed by the feed point, the elongate radiating element extending along only a portion of the helical radiating element, the elongate radiating element having a first resonant frequency and a second resonant frequency, the elongate radiating element operating as a quarter-wavelength monopole at the first resonant frequency and as an eighth-wavelength monopole at the second resonant frequency.

16 Claims, 3 Drawing Sheets

(51) Int. Cl.

| | |
|---|---|
| ***H01Q 11/12*** | (2006.01) |
| ***H01Q 21/30*** | (2006.01) |
| ***H01Q 1/36*** | (2006.01) |
| ***H01Q 9/30*** | (2006.01) |
| *H01Q 9/40* | (2006.01) |

(58) Field of Classification Search
USPC ..... 343/725
See application file for complete search history.

(56) References Cited

U.S. PATENT DOCUMENTS

| | | | | |
|---|---|---|---|---|
| 6,008,765 | A * | 12/1999 | Davidson | H01Q 1/244 343/702 |
| 6,608,605 | B2 * | 8/2003 | Lee | H01Q 1/241 343/745 |
| 7,183,998 | B2 * | 2/2007 | Wilhelm | H01Q 1/362 343/895 |
| 7,259,728 | B1 * | 8/2007 | Ostervall | H01Q 1/10 343/702 |
| 8,115,690 | B2 * | 2/2012 | Koh | H01Q 5/00 343/702 |
| 2002/0018026 | A1 | 2/2002 | Noro | |
| 2010/0188303 | A1 | 7/2010 | Koh et al. | |
| 2011/0267253 | A1 * | 11/2011 | Bit-Babik | H01Q 1/244 343/860 |

* cited by examiner

100
IB
IB
102
104
106
108
110
111
112
114
116
116
120

MULTIBAND HELICAL ANTENNA

REFERENCE TO RELATED APPLICATIONS

Reference is hereby made to U.S. Provisional Patent Application 61/817,909, entitled SIMPLIFIED STRUCTURE FOR MULTIBAND ANTENNA, filed May 1, 2013, the disclosure of which is hereby incorporated by reference and priority of which is hereby claimed pursuant to 37 CFR 1.78(a)(4) and (5)(i).

FIELD OF THE INVENTION

The present invention relates generally to antennas and more particularly to multiband antennas.

BACKGROUND OF THE INVENTION

Various types of multiband antennas are known in the art.

SUMMARY OF THE INVENTION

The present invention seeks to provide an improved multiband helical antenna having a highly compact structure.

There is thus provided in accordance with a preferred embodiment of the present invention a multiband antenna including a feed point, a helical radiating element galvanically connected to and fed by the feed point, the helical radiating element resonating in a Very High Frequency range and an elongate radiating element arranged coaxially within the helical radiating element and galvanically connected to and fed by the feed point, the elongate radiating element extending along only a portion of the helical radiating element, the elongate radiating element having a first resonant frequency and a second resonant frequency, the elongate radiating element operating as a quarter-wavelength monopole at the first resonant frequency and as an eighth-wavelength monopole at the second resonant frequency.

Preferably, the helical radiating element operates in a frequency range of 136-174 MHz.

Preferably, the first resonant frequency is generally equal to 800 MHz and the second resonant frequency is generally equal to 400 MHz.

Alternatively, the first resonant frequency is generally equal to 1600 MHz and the second resonant frequency is generally equal to 800 MHz.

Preferably, the frequency range of operation of the helical radiating element is offset from the first resonant frequency by at least 250 MHz.

In accordance with a preferred embodiment of the present invention, the elongate radiating element extends along less than 35% of the helical radiating element.

Preferably, the elongate radiating element extends along between 3-7 cm of the helical radiating element.

Preferably, the elongate radiating element extends along between 4-6 cm of the helical radiating element.

In accordance with another preferred embodiment of the present invention, the helical radiating element has a dual-pitch.

Preferably, the helical radiating element includes a first portion proximal to the feed point and having a first pitch and a second portion distal from the feed point and having a second pitch.

Preferably, the second pitch is smaller than the first pitch.

Preferably, the first portion is shorter than the second portion.

Preferably, the multiband antenna also includes a threaded insert extending along the first portion, for maintaining the first pitch.

Preferably, the multiband antenna also includes a matching circuit connected to the helical radiating element and the elongate radiating element.

There is further provided in accordance with another preferred embodiment of the present invention a multiband antenna including a feed point, a dual-pitch helical radiating element galvanically connected to and fed by the feed point, the dual-pitch helical radiating element resonating in a Very High Frequency range and an elongate radiating element arranged coaxially within the dual-pitch helical radiating element and galvanically connected to and fed by the feed point, the elongate radiating element extending along only a portion of the dual-pitch helical radiating element, the elongate radiating element having a first resonant frequency and a second resonant frequency, the elongate radiating element operating as a quarter-wavelength monopole at the first resonant frequency and as an eighth-wavelength monopole at the second resonant frequency.

Preferably, the dual-pitch helical radiating element includes a first portion having a first pitch and a second portion having a second pitch, the second pitch being smaller than the first pitch.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figures 1A, 1B:
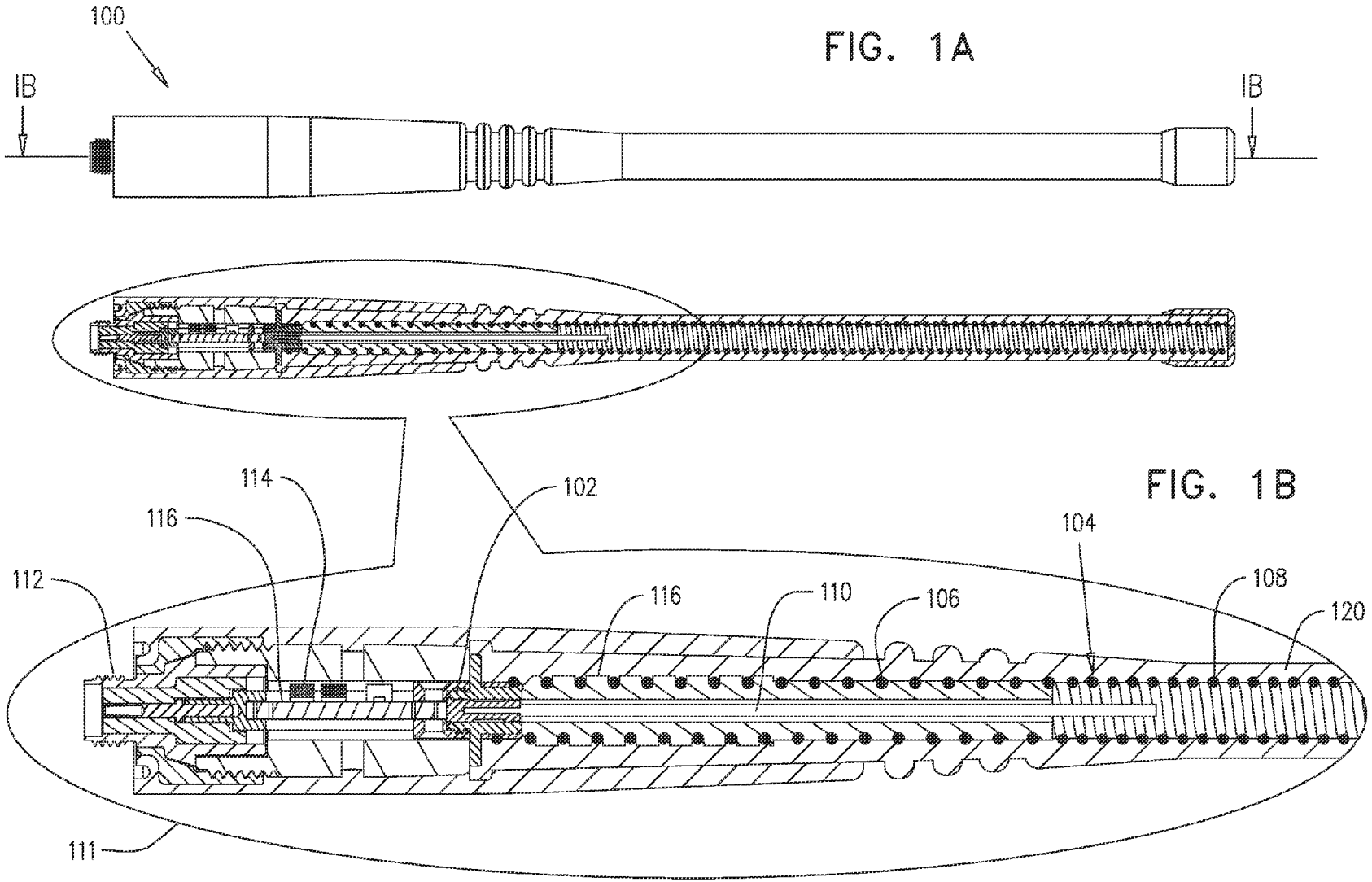
FIGS. 1A, 1B, 1C and 1D are simplified respective side, cross-sectional, exploded and perspective view illustrations of a multiband antenna constructed and operative in accordance with a preferred embodiment of the present invention.

Reference is now made to FIGS. 1A, 1B, 1C and 1D, which are simplified respective side, cross-sectional, exploded and perspective view illustrations of a multiband antenna constructed and operative in accordance with a preferred embodiment of the present invention.

As seen in FIGS. 1A-1D, there is provided an antenna 100, including a feed point 102 and a helical radiating element 104 galvanically connected to and fed by feed point 102. Helical radiating element 104 is preferably embodied as a cylindrical helical radiating element. It is appreciated, however, that helical radiating element 104 may alternatively be embodied in a variety of configurations, including hexagonal or square-helical.

Helical radiating element 104 is preferably embodied as a dual-pitch helical radiating element, preferably including a first lower portion 106, proximal to feed point 102 and having a first pitch and a second upper portion 108, distal from feed point 102 and having a second pitch. As seen most clearly in FIG. 1C, the second pitch of second upper portion 108 is preferably smaller than the first pitch of first lower portion 106.

First portion 106 may, by way of example, be shorter and comprise a fewer number of turns than second portion 108. By way of example, first portion 106 may comprise 16 helical turns, each spaced apart by approximately 3.5 mm and second portion 108 may comprise 65 helical turns, each spaced apart by approximately 2.7 mm. First and second portions 106 and 108 may have a diameter of approximately 5.8 mm and be formed by a coiled wire having a thickness of approximately 0.9 mm. It is appreciated, however, that these particular described configurations of first and second portions 106 and 108 are exemplary only and may be modified according to the desired operating characteristics of antenna 100, as will be described henceforth. Helical radiating element 104 preferably has an electrical length for resonating in the Very High Frequency (VHF) range, preferably spanning approximately 136-174 MHz.

An elongate radiating element 110 is preferably arrange coaxially within helical radiating element 104 and is galvanically connected to and fed by feed point 102. It is appreciated that feed point 102 thus serves as a common galvanic feed point for both helical radiating element 104 and elongate radiating element 110. Elongate radiating element 110 is preferably embodied as a straight insulated wire formed by a suitable conductive material such as copper.

It is a particular feature of a preferred embodiment of the present invention that elongate radiating element 110 does not extend fully along a length of helical radiating element 104 but rather extends only partially along and within helical radiating element 104. By way of example, helical radiating element 104 may have a physical length of approximately 18 cm and elongate radiating element 110 may have a physical length of approximately 5.1 cm, such that elongate radiating element 110 extends along only a small portion of the physical length of helical radiating element 104. Preferably, elongate radiating element 110 extends along less than approximately 35% of helical radiating element 104. Particularly preferably, elongate radiating element 110 extends along between approximately 3-7 cm and even more particularly preferably along between approximately 4-6 cm of helical radiating element 104.

Elongate radiating element 110 preferably operates as a monopole radiating element having a first resonant frequency, wherein the first resonant frequency has a corresponding associated first wavelength and elongate radiating element 110 has an electrical length generally equal to a quarter of that first wavelength. It is appreciated that elongate radiating element 110 thus operates as a quarter-wavelength monopole at its first resonant frequency. The operation of an elongate radiating element as a quarter-wavelength monopole will be readily understood by one skilled in the art as a typical mode of operation of a whip monopole element. The first resonant frequency of elongate radiating element 110 may be in the 800 MHz range.

In addition to the first resonant frequency of elongate radiating element 110, however, it has been found that when elongate radiating element 110 is positioned as described above within helical radiating element 104, elongate radiating element 110 operates as a monopole radiating element exhibiting an additional second resonant frequency. The second resonant frequency of elongate radiating element 110 has a corresponding associated second wavelength and the electrical length of elongate radiating element 110 is preferably generally equal to an eighth of that second wavelength. It is appreciated that elongate radiating element 110 thus operates as an eighth-wavelength monopole at its second resonant frequency. The second resonant frequency of elongate radiating element 110 may be in the 400 MHz range.

As will be readily appreciated by one skilled in the art, the operation of elongate radiating element 110 as an eighth-wavelength monopole radiating element is surprising and atypical of whip monopole elements. The operation of elongate radiating element 110 as an eighth-wavelength monopole radiating element seems to arise due to the particular location thereof within VHF helical radiating element 104 and due to the disparity in the preferable respective operating frequencies of helical radiating element 104 and elongate radiating element 110. The VHF operating frequency of helical radiating element 104 is preferably offset from the first resonant frequency of elongate radiating element 110 by at least 250 MHz.

Figure 1C:
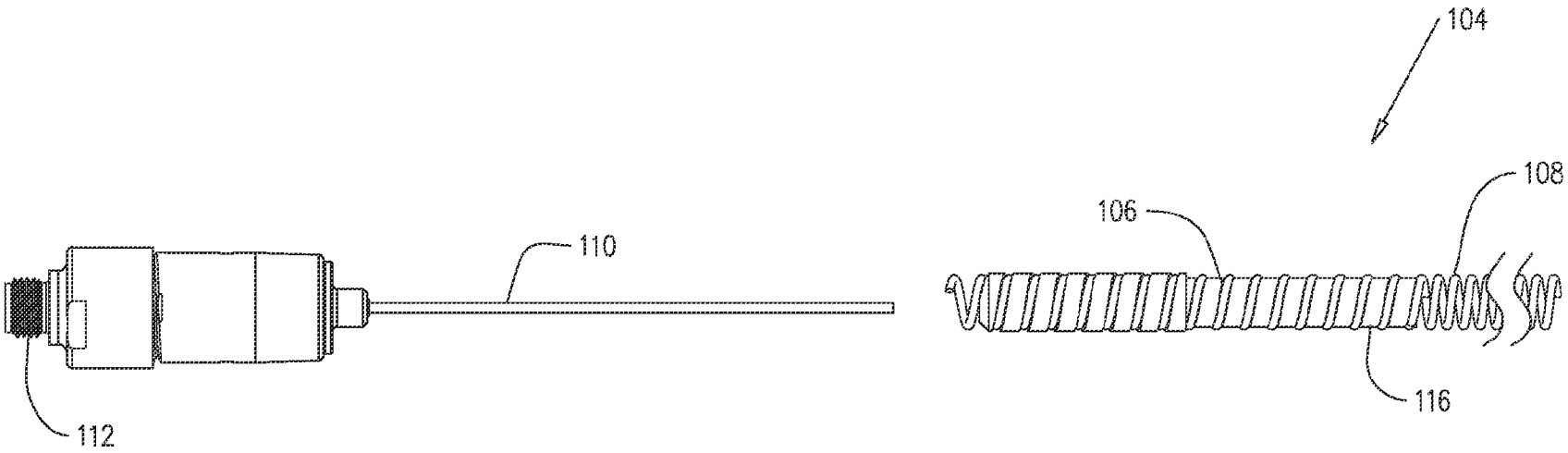
Figure 1D:
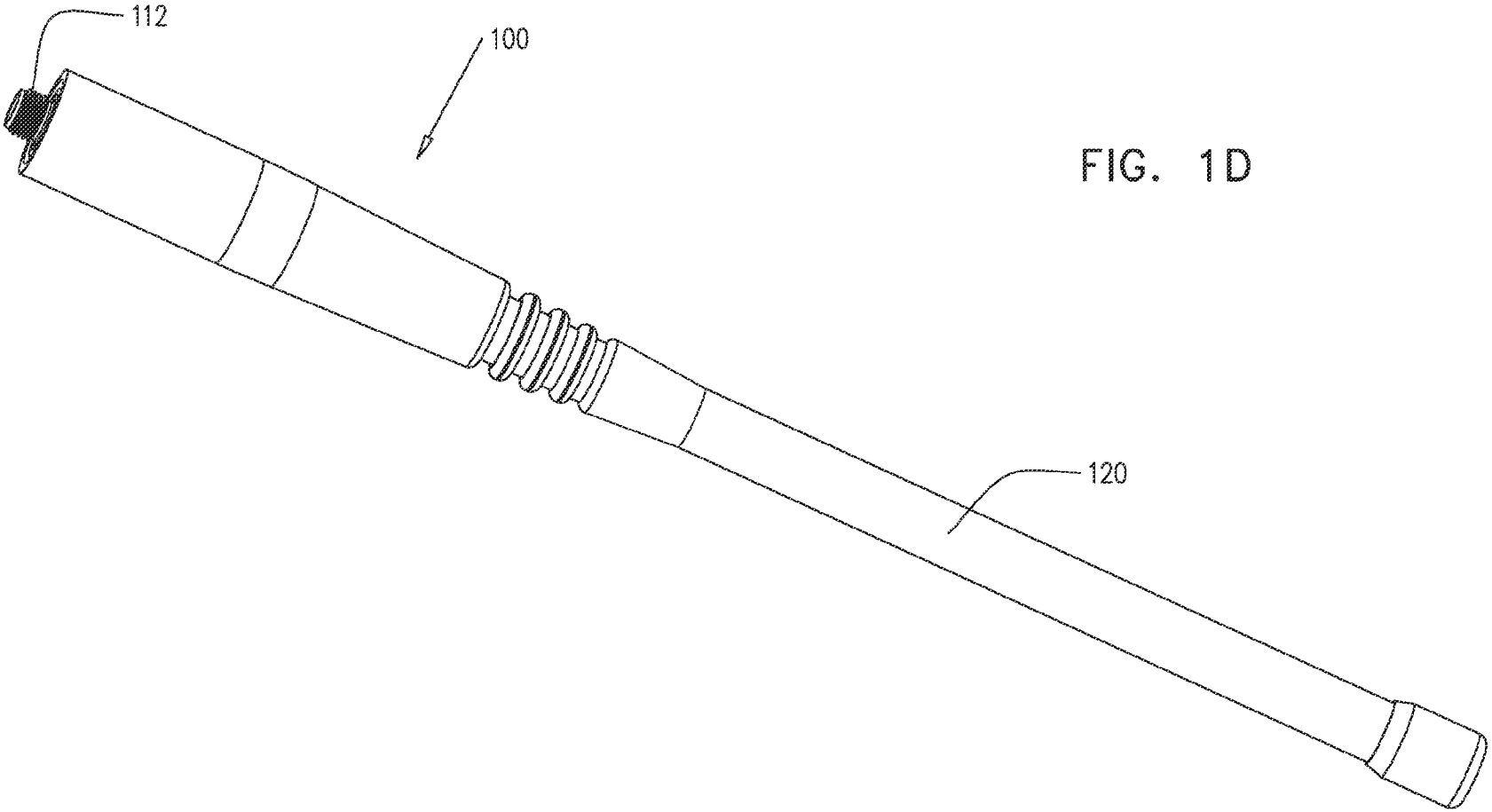

The embodiment of helical radiating element 104 as a dual-pitch helical radiating element, as shown in FIGS. 1B and 1C, has been found to provide particularly advantageous performance of antenna 100, as it allows tuning of the first, second and VHF resonant frequencies of antenna 100 by way of adjustment of the parameters of the helices respectively forming first and second portions 106 and 108 of helical radiating element 104. However, the above-described surprising operation of elongate radiating element 110 as an eighth-wavelength monopole when so disposed within helical radiating element 104 is not limited to the case wherein helical radiating element 104 is a dual-pitch helical radiating element. Helical radiating element 104 thus may alternatively be embodied as a single-pitch helical radiating element, depending on the required operating characteristics of antenna 100.

It is understood that as a result of the VHF resonant frequency arising due to the operation of helical radiating element 104 and the first and second resonant frequencies arising due to the operation of elongate radiating element 110, antenna 100 is preferably operative as a tri-band antenna. In contrast to conventional somewhat comparable multiband antennas, which conventional multiband antennas typically have complex structures, antenna 100 has an advantageously simple structure including only a few parts and is thus compact, highly flexible, cost-efficient, light and easy to assemble.

It is appreciated that the operation of elongate radiating element 110 is not limited to the 400/800 MHz range. Elongate radiating element 110 may alternatively have an electrical length such that elongate radiating element 110 radiates in the 800/1600 MHz range. In this case, the radiation pattern of elongate radiating element 110 in the 1600 MHz range is predominantly directed upwards, this being particularly advantageous for GPS applications.

As seen most clearly at enlargement 111 in FIG. 1B, helical radiating element 104 and elongate radiating element 110 are preferably connected to a radio-frequency connector 112 by way of a matching circuit 114, which matching circuit 114 is preferably formed on a surface of a printed circuit board 116. It is appreciated, however, that the inclusion of matching circuit 114 in antenna 100 is optional and that matching circuit 114 may be obviated should helical and elongate radiating elements 104 and 110 be sufficiently well matched to an input impedance of radio-frequency connector 112.

Antenna 100 may further include a threaded insert 116, seen most clearly in FIG. 1C. Threaded insert 116 preferable functions to maintain the first pitch of lower portion 106 of helical radiating element 104 as well as to hold elongate element 110 concentrically in place within the bore of helical radiating element 104. It is appreciated, however, that threaded insert 116 may be obviated or replaced by other holding means as are well known in the art.

Antenna 100 may be installed as an external whip-type antenna attached to a portable electronic device such as a Land Mobile Radio (LMR). In this case, antenna 100 may be housed by an outer protective insulative cover, such as a cover 120 seen most clearly in FIG. 1D. It is appreciated that cover 120 is omitted from FIG. 1C for the sake of clarity of presentation only. It is further understood that antenna 100 is not limited to installation on LMR devices, and may alternatively be employed as an internal or external antenna in a variety of appropriate portable or non-portable electronic devices.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. A multiband antenna comprising:

a feed point;

a helical radiating element galvanically connected to and fed by said feed point, said helical radiating element comprising a coiled wire extending from said feed point to an end of the multiband antenna, said helical radiating element resonating in a Very High Frequency range; and an elongate radiating element comprising a substantially straight insulated wire separate from the coiled wire of the helical radiating element and arranged coaxially within the coiled wire of said helical radiating element and galvanically connected to and fed by said feed point, said elongate radiating element extending within only a portion of said helical radiating element, said elongate radiating element having a first resonant frequency and a second resonant frequency, said elongate radiating element operating as a quarter-wavelength monopole at said first resonant frequency and as an eighth-wavelength monopole at said second resonant frequency.

2. A multiband antenna according to claim 1, wherein said helical radiating element operates in a frequency range of 136-174 MHz.

3. A multiband antenna according to claim 1, wherein said first resonant frequency is generally equal to 800 MHz and said second resonant frequency is generally equal to 400 MHz.

4. A multiband antenna according to claim 1, wherein said first resonant frequency is generally equal to 1600 MHz and said second resonant frequency is generally equal to 800 MHz.

5. A multiband antenna according to claim 2, wherein said frequency range of operation of said helical radiating element is offset from said first resonant frequency by at least 250 MHz.

6. A multiband antenna according to claim 1, wherein said elongate radiating element extends along less than 35% of said helical radiating element.

7. A multiband antenna according to claim 6, wherein said elongate radiating element extends along between 3-7 cm of said helical radiating element.

8. A multiband antenna according to claim 7, wherein said elongate radiating element extends along between 4-6 cm of said helical radiating element.

9. A multiband antenna according to claim 1, wherein said helical radiating element has a dual-pitch.

10. A multiband antenna according to claim 9, wherein said helical radiating element comprises a first portion proximal to said feed point and having a first pitch and a second portion distal from said feed point and having a second pitch.

11. A multiband antenna according to claim 10, wherein said second pitch is smaller than said first pitch.

12. A multiband antenna according to claim 10, wherein said first portion is shorter than said second portion.

13. A multiband antenna according to claim 10, and also comprising a threaded insert extending along said first portion, for maintaining said first pitch.

14. A multiband antenna according to claim 1, and also comprising a matching circuit connected to said helical radiating element and said elongate radiating element.

15. A multiband antenna comprising:

a feed point;

a dual-pitch helical radiating element galvanically connected to and fed by said feed point, said dual-pitch helical radiating element comprising a coiled wire extending from said feed point to an end of the multiband antenna, said dual-pitch helical radiating element resonating in a Very High Frequency range; and an elongate radiating element comprising a substantially straight insulated wire separate from the coiled wire of the helical radiating element and arranged coaxially within said coiled wire of the dual-pitch helical radiating element and galvanically connected to and fed by said feed point, said elongate radiating element extending within only a portion of said dual-pitch helical radiating element, said elongate radiating element having a first resonant frequency and a second resonant frequency, said elongate radiating element operating as a quarter-wavelength monopole at said first resonant frequency and as an eighth-wavelength monopole at said second resonant frequency.

16. A multiband antenna according to claim 15, wherein said dual-pitch helical radiating element comprises a first portion having a first pitch and a second portion having a second pitch, said second pitch being smaller than said first pitch.

* * * * *